US009556884B2

(12) United States Patent
Burman

(10) Patent No.: US 9,556,884 B2
(45) Date of Patent: Jan. 31, 2017

(54) PROPELLER PUMP FOR PUMPING LIQUID

(71) Applicant: XYLEM IP MANAGEMENT S.à r.l., Senningerberg (LU)

(72) Inventor: Jörgen Burman, Järfälla (SE)

(73) Assignee: XYLEM IP MANAGEMENT S.À.R.L., Senningerberg (LU)

( * ) Notice: Subject to any disclaimer, the term of this patent is extended or adjusted under 35 U.S.C. 154(b) by 0 days.

(21) Appl. No.: 14/901,146

(22) PCT Filed: Jun. 28, 2013

(86) PCT No.: PCT/EP2013/063588
§ 371 (c)(1),
(2) Date: Dec. 28, 2015

(87) PCT Pub. No.: WO2014/206478
PCT Pub. Date: Dec. 31, 2014

(65) Prior Publication Data
US 2016/0131157 A1 May 12, 2016

(51) Int. Cl.
*F04D 3/00* (2006.01)
*F04D 29/18* (2006.01)
(Continued)

(52) U.S. Cl.
CPC ..... *F04D 29/542* (2013.01); *F04D 3/005* (2013.01); *F04D 29/181* (2013.01);
(Continued)

(58) Field of Classification Search
CPC ..... F04D 3/005; F04D 29/181; F04D 29/528; F04D 29/542; F04D 29/548; F04D 29/688
See application file for complete search history.

(56) References Cited

U.S. PATENT DOCUMENTS 1,971,386 A * 8/1934 Schmidt ..... F04D 3/005 415/201
3,910,728 A * 10/1975 Sloan ..... F04D 13/046 417/390

(Continued)

FOREIGN PATENT DOCUMENTS

WO 2013090500 6/2013

OTHER PUBLICATIONS

International Preliminary Report on Patentability for International Application No. PCT/EP2013/063588 mailed Jun. 11, 2015.

(Continued)

*Primary Examiner* — Igor Kershteyn
(74) *Attorney, Agent, or Firm* — RatnerPrestia

(57) ABSTRACT

Propeller pump for pumping liquid, including: an axially extending tubular pump housing having an inner surface, an axially extending pump core having an envelope surface, at least one axial portion of the pump core enclosed in the pump housing. The pump core includes a propeller having a hub and at least one blade, and at least one guide vane that includes an upstream leading edge and a downstream trailing edge, and that in the circumferential direction includes a pressure side and a suction side. The guide vane extends between the inner surface of the pump housing and the envelope surface of the pump core. At the leading edge of the guide vane a connection angle between the suction side of the guide vane and the envelope surface of the pump core is larger than 90 degrees.

7 Claims, 5 Drawing Sheets

(51) Int. Cl.
*F04D 29/52* (2006.01)
*F04D 29/54* (2006.01)
*F04D 29/68* (2006.01)

(52) U.S. Cl.
CPC ..... *F04D 29/528* (2013.01); *F04D 29/548* (2013.01); *F04D 29/688* (2013.01)

(56) References Cited

U.S. PATENT DOCUMENTS 3,957,402 A * 5/1976 Sloan ..... F04D 13/046
415/121.2
4,427,338 A 1/1984 Furst
5,221,182 A * 6/1993 Arbeus ..... F04D 29/448
415/208.1
5,385,447 A 1/1995 Geister

OTHER PUBLICATIONS

International Search Report for International Application No. PCT/EP2013/063588 mailed Mar. 21, 2014.
Written Opinion of the International Searching Authority for International Application No. PCT/EP2013/063588 mailed Mar. 21, 2014.

* cited by examiner

PROPELLER PUMP FOR PUMPING LIQUID

CROSS-REFERENCE TO RELATED APPLICATIONS

This patent application is a U.S. National Phase Patent Application of PCT Application No. PCT/EP2013/063588, filed Jun. 28, 2013, which is incorporated by reference herein in its entirety.

TECHNICAL FIELD OF THE INVENTION

The present invention relates generally to a propeller pump for pumping liquid, and specifically to a semi axial pump or diagonal pump where the incoming liquid flow/is sucked in parallel with the rotational axis of the propeller pump and where the liquid leave the propeller of the propeller pump at an angle to said rotational axis, which angle is greater than 0 degrees, less than 90 degrees and usually about 45 degrees. Thereto, the rotation of the propeller causes the liquid flow leaving the propeller to present a component in the circumferential direction. The usual field of application for such a propeller pump is to transport large amounts of liquid having relatively low pressure.

The present invention relates to a propeller pump comprising an axially extending tubular pump housing having an inner surface, an axially extending pump core having an envelop surface, at least one axial part section of the pump core being enclosed of said pump housing, and the pump core comprising a propeller having a hub and at least one blade, and at least one guide vane that comprises an upstream located leading edge and a downstream located trailing edge, and that in the circumferential direction comprises a pressure side and a suction side, said at least one guide vane extending between the inner surface of the pump housing and the envelope surface of the pump core, wherein, at the leading edge of said at least one guide vane, a connection angle $\alpha$ between the suction side of the guide vane and the envelope surface of the pump core is bigger than 90 degrees.

BACKGROUND OF THE INVENTION AND PRIOR ART

In a section of such a propeller pump, a so-called diffuser having guide vanes is found, which is a section of the propeller pump wherein deflection of the flow of the liquid stream as well as pressure recovery occurs after the liquid has left the propeller of the propeller pump. More precisely, the function of the diffuser and guide vanes is to deflect/reroute the liquid stream that leaves the propeller of the propeller pump in the rotational direction as well as in the radial-axial direction, with the purpose of obtaining an output liquid stream from the diffuser and primarily parallel to the rotation axis of the propeller pump. Constructionwise, this means, among other things, that the pump core has a convex shape downstream the propeller in order to deflect the liquid stream partly directed radially outward that leaves the propeller into an axial liquid stream.

When the diameter of the convex surface no longer increases, but changes to levelling out or slightly decreasing, a negative pressure gradient is provided that is directed upstream parallel to the envelope surface of the pump core and that is adjacent to the envelope surface of the pump core. This so-called negative axial pressure gradient increases when the radius of curvature of the convex surface begins to increase, i.e., begins to level out, as viewed in the axial direction, which implies that a boundary layer closest to the envelope surface of the pump core also increases in the direction downstream. The boundary layer exhibits a considerably reduced speed and eventually a rearwardly directed speed, or reverse flow/stream. In order to avoid that the negative axial pressure gradient becomes so large that reverse flow arises, it is known to make the radius of curvature of the convex surface sufficiently large. However, this implies the disadvantage that the axial length of the propeller pump increases, which is most pronounced for large propeller pumps having a diameter of approx. 1-2 m and an axial length of approx. 3-4 m.

Furthermore, the area wherein the suction side of the guide vane meets the envelope surface of the pump core is extra susceptible to separation, i.e., emergence of reverse flow. This depends foremost on the boundary layer along the envelope surface of the pump core being added to a such a boundary layer that is present on the suction side of the guide vane in the area where the radius of curvature of the convex suction side of the guide vane begins to increase, as viewed in the axial direction, which in summary leads to further increased risk of reverse flow and thereby large losses.

BRIEF DESCRIPTION OF THE OBJECTS OF THE INVENTION

The present invention aims at obviating the above-mentioned disadvantages and failings of prior art propeller pumps and at providing an improved propeller pump. A primary object of the invention is to provide an improved propeller pump of the type defined by way of introduction, which eliminates separation in the area between the suction side of the guide vane and the envelope surface of the pump core by decreasing the total boundary layer that is found in the area where the suction side of the guide vane meets the envelope surface of the pump core.

A further object of the present invention is to provide a propeller pump, the axial length of which can be decreased thanks to the radius of curvature of the convex surface of the pump core being allowed to be decreased, thereby requiring a shorter axial distance to deflect the liquid stream in the radial-axial direction.

It is another object of the present invention to provide a propeller pump, in which the envelope surface of the pump core has a very large or no radius of curvature, as viewed in the axial direction, in the guide vane passage.

It is another object of the present invention to provide a propeller pump, wherein deflection in the rotational direction does not occur in the same place as deflection in the radial-axial direction.

BRIEF DESCRIPTION OF THE INVENTION

According to the invention, at least the primary object is achieved by means of the propeller pump that is defined by way of introduction and has the features defined in the independent claim. Preferred embodiments of the present invention are furthermore defined in the depending claims.

According to the present invention, a propeller pump of the type defined by way of introduction is provided, which is characterized in that, the pump core downstream the propeller exhibits a maximum diameter ($d_{max}$), the leading edge of said at least one guide vane connecting to the envelope surface of the pump core at a point downstream the transverse cross-section where the pump core has maximum diameter ($d_{max}$).

Thus, the present invention is based on the understanding that by providing a connection angle between the suction side of the guide vane and the envelope surface of the pump core that is greater than 90°, an inwardly directed radial pressure gradient is obtained that decreases the boundary layer and increases the linear momentum in the area between the suction side of the guide vane and the envelope surface of the pump core, thereby eliminating separation in this area. The location of the connection between the leading edge of the guide vane and envelope surface of the pump core implies that the risk of separation decreases considerably as a consequence of deflection in the rotational direction taking place downstream the deflection in the radial-axial direction.

According to a preferred embodiment, the connection angle ($\alpha$) between the suction side of the guide vane and the envelope surface of the pump core is greater than 90° along the entire axial length of the guide vane, which further decreases the risk of separation.

Preferably, the propeller pump comprises an axially extending channel, wherein a cross-sectional area ($A_1$) of said channel, in the area of the leading edge of said at least one guide vane, is smaller than or equal to a cross-sectional area ($A_2$) of said channel in the area of the trailing edge of said at least one guide vane, and wherein the cross-sectional area ($A_2$) of said channel, in the area of the trailing edge of said at least one guide vane, is smaller than a factor of 1,2 times the cross-sectional area ($A_1$) of said channel in the area of the leading edge of said at least one guide vane. This leads to further decreased risk of separation as a consequence of the expansion/area increase of the channel being small in the axial section where the guide vanes are arranged.

Further advantages and features of the invention are found in the other dependent claims as well as in the following, detailed description of preferred embodiments.

FURTHER ELUCIDATION OF PRIOR ART

Document WO 2013-090500 disclose a propeller pump for pumping liquid. The propeller pump comprises an axially extending tubular pump housing enclosing an axially extending pump core having a propeller. At least one guide vane extend between the pump core and the pump housing, wherein, at the leading edge of the guide vane, a connection angle ($\alpha$) between the suction side of the guide vane and the envelope surface of the pump core is bigger than 90 degrees.

BRIEF DESCRIPTION OF THE DRAWINGS

A more complete understanding of the above-mentioned and other features and advantages of the present invention will be apparent from the following, detailed description of preferred embodiments, reference being made to the accompanying drawings, wherein.

DETAILED DESCRIPTION OF PREFERRED EMBODIMENTS

Figure 1:
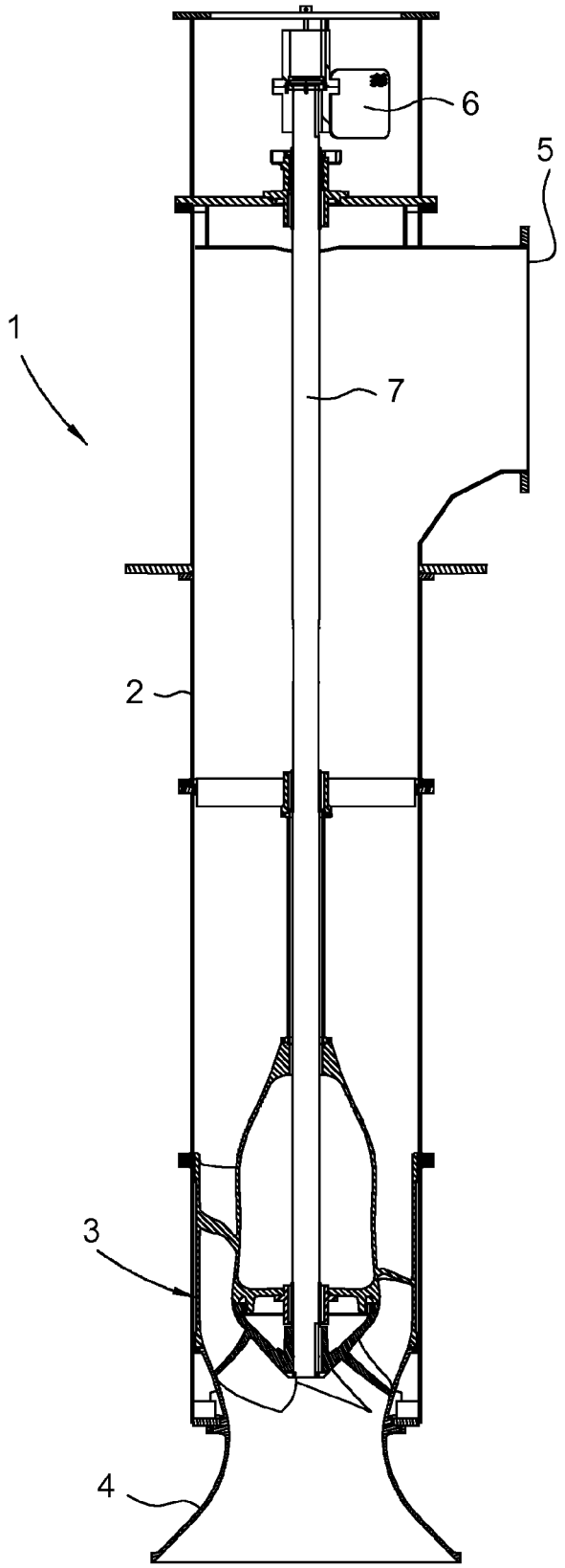
FIG. 1 is a schematic cross sectional side view of a propeller pump installation.

Reference is made by way of introduction to FIG. 1, which shows a propeller pump installation, generally designated 1. The propeller pump installation 1 comprises a casing tube 2 having one or more sections, a propeller pump according to the invention, generally designated 3, arranged in a lower end of said casing tube 2, an inlet funnel 4 connected to the lower end of the casing tube 2, an outlet 5 arranged in an upper end of the casing tube 2, and a drive unit 6. In the embodiment shown, the drive unit 6 is located at a distance from the propeller pump 3, and situated outside the casing tube 2, and is connected to the propeller pump 3 by means of an axially extending drive shaft 7, however, it should be mentioned that the drive unit 6 may be arranged in the proper propeller pump 3.

Figure 2:
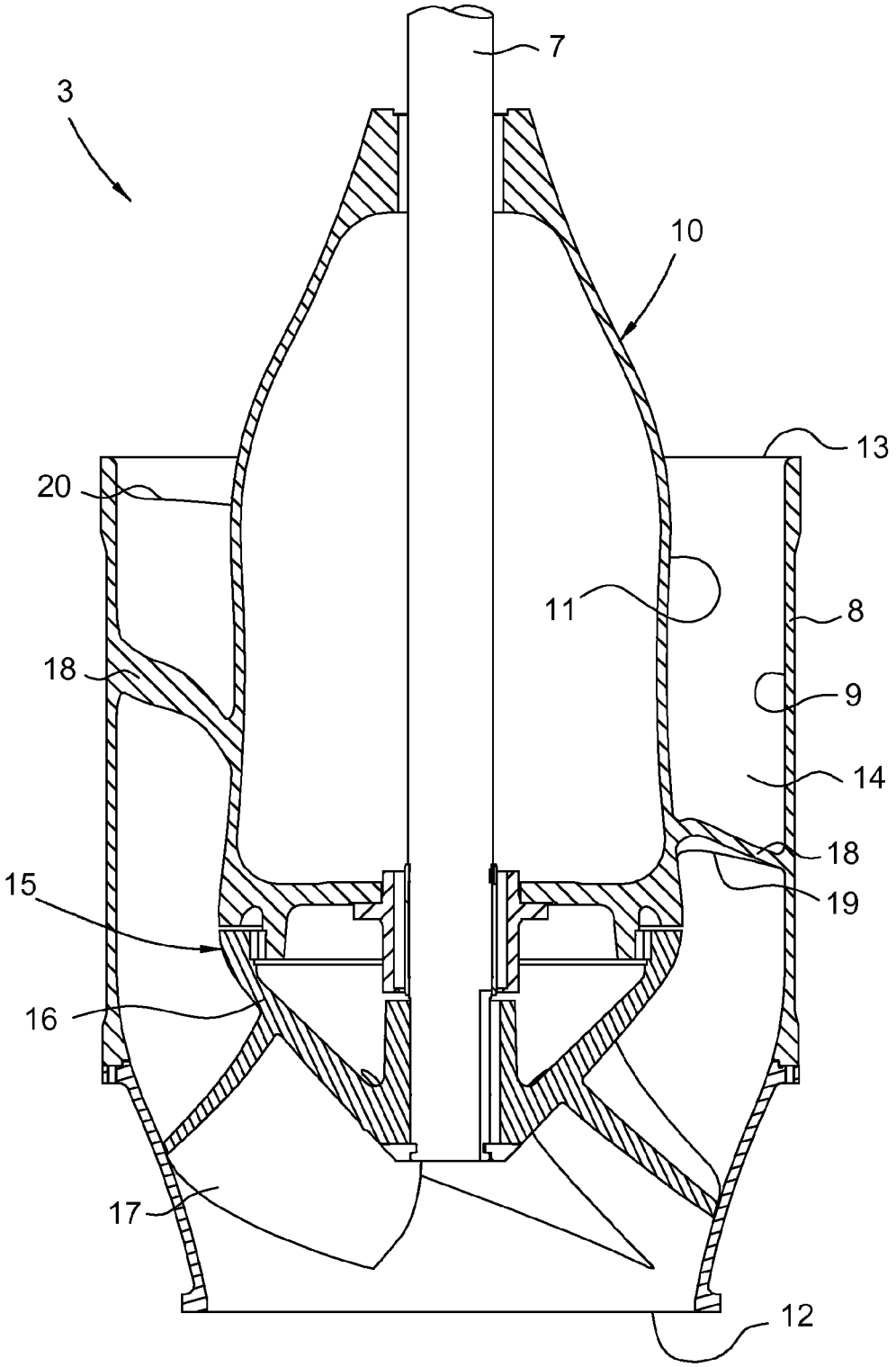
FIG. 2 is a schematic cross sectional side view of a propeller pump according to the invention.
Figure 3:
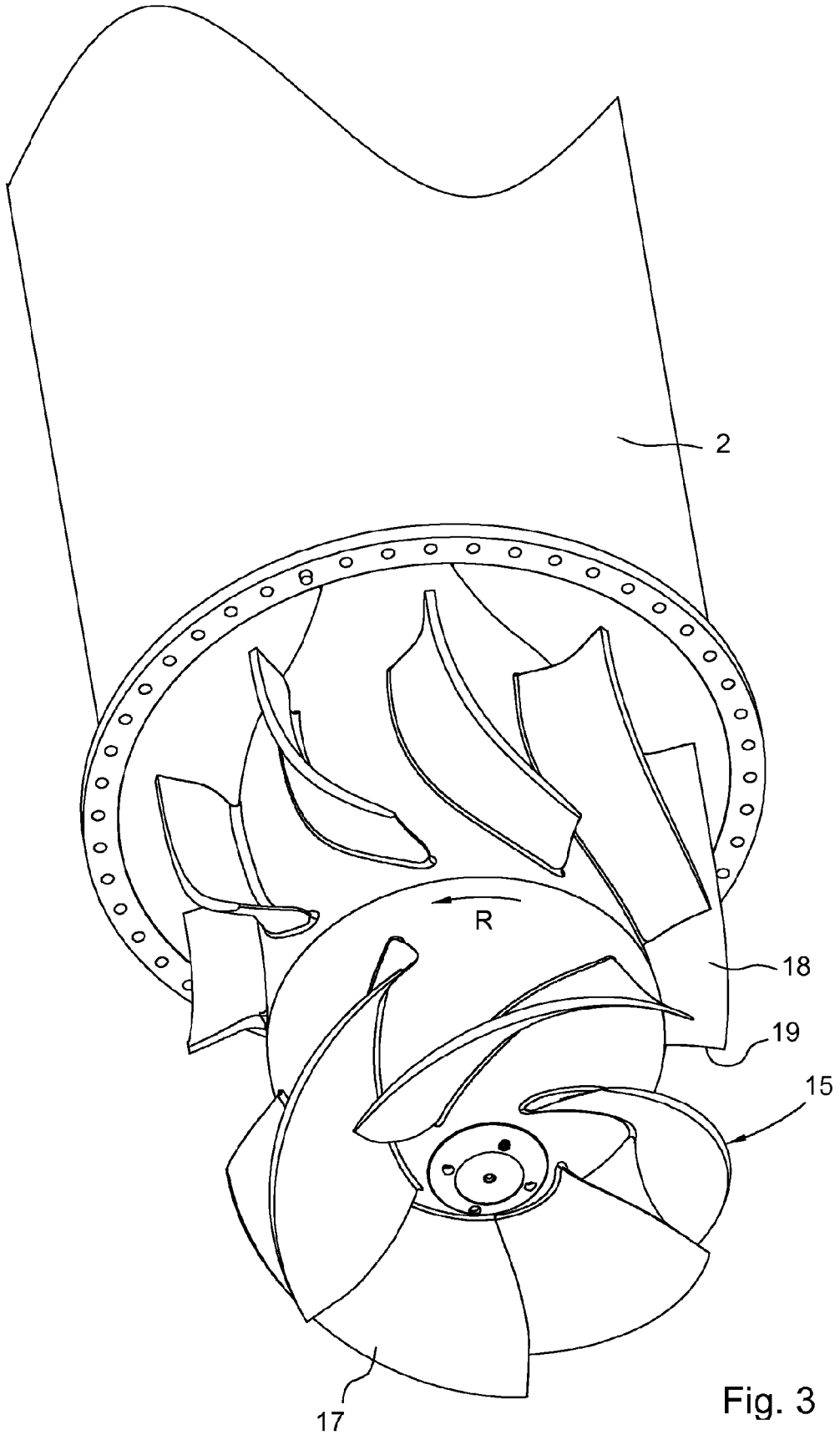
FIG. 3 is a schematic perspective view from below of a propeller pump according to the invention wherein the tubular pump housing is removed.
Figure 4:
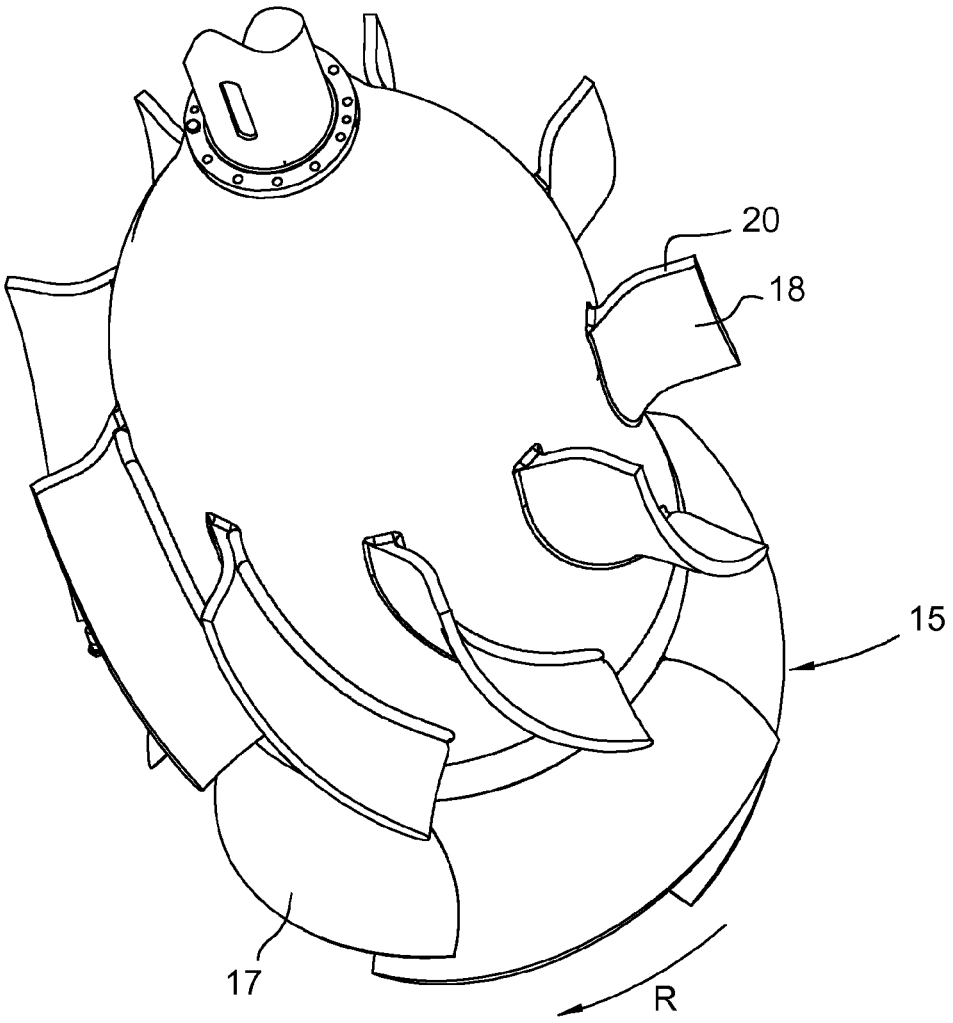
FIG. 4 is a schematic perspective view from above of the propeller pump according to FIG. 3.

Reference is now also made to FIGS. 2-4, which show a propeller pump 3 according to the invention. The propeller pump 3 is also known as semi-axial pump or diagonal flow pump, and comprises an axially extending tubular pump housing 8 having an inner surface 9, and an axially extending pump core, generally designated 10, having an envelope surface 11. At least one axial subsection of the pump core 10 is surrounded by said pump housing 8, and preferably the pump housing 8 and the pump core 10 are concentrically arranged in relation to each other. It should be mentioned that the drive unit 6 may be arranged in the pump core 10. In FIGS. 3 and 4, the pump housing 8 is removed for the purpose of clarification.

The pump housing 8 comprises an upstream located inlet 12 and a downstream located outlet 13, the propeller pump 3 comprising an axially extending channel 14 that extends from the inlet opening 12 to the outlet opening 13, which channel 14 is radially delimited by the inner surface 9 of the pump housing 8 and the envelope surface 11 of the pump core 10, respectively. The pump core 10 comprises a propeller 15 having a hub cone 16 and at least one blade 17 projecting from said hub cone 16. It should be clarified that the envelope surface 11 of the pump core 10 partly consists of the outside of said hub cone 16. The hub cone 16 of the propeller 15 is connected to the lower end of the drive shaft 7 and is driven in rotation by the drive unit 6 via said drive shaft 7. The direction of rotation of the propeller 15 is illustrated by the arrow R in FIGS. 3 and 4.

In the embodiment shown in the figures, the propeller 15 comprises five blades 17, which are equidistantly distributed along the hub cone 16. However, the propeller 15 may comprise another number of blades 17; the number of propeller blades is selected, for instance, based on specification of performance requirements and based on the desire to avoid vibrations because of resonance when the propeller pump 3 is in operation and based on balancing of the propeller 15.

Figure 5:
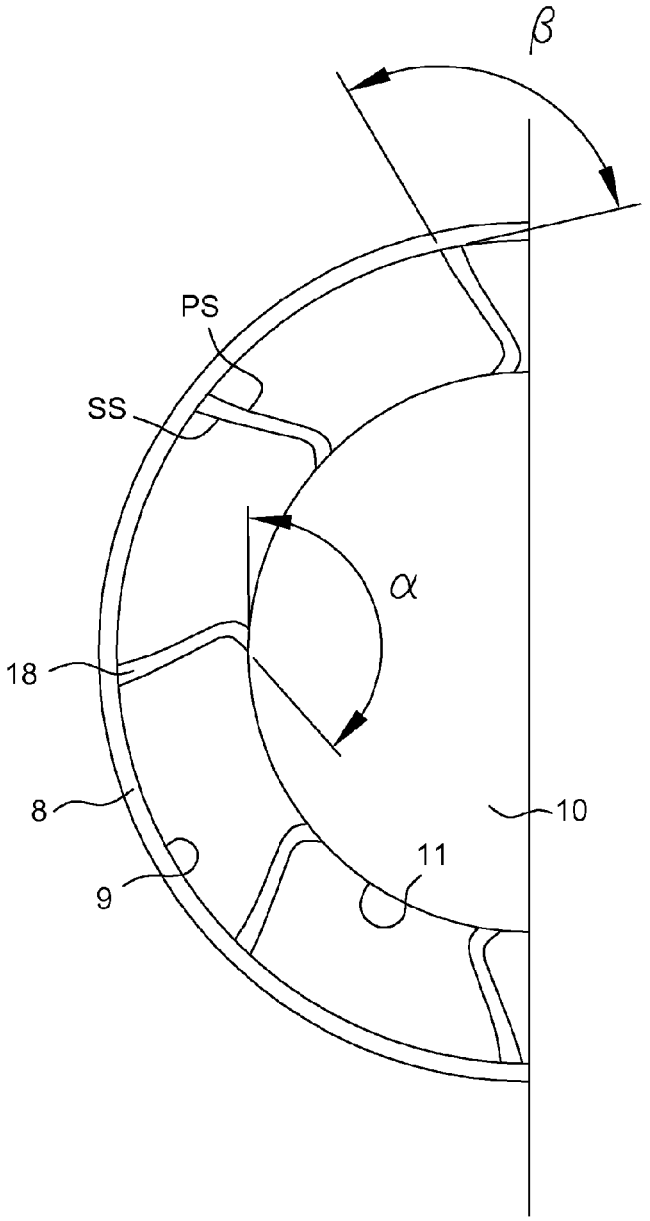
FIG. 5 is an illustration of a cross sectional view of a propeller pump according to the invention taken in a transverse plane in the downstream direction showing the leading edge of the guide vanes.

The propeller pump 3 comprises furthermore at least one guide vane 18, which has an upstream located leading edge 19 and a downstream located trailing edge 20, and which, in the direction of rotation, comprises a pressure side (PS) and a suction side (SS) (see FIG. 5). In the embodiment shown in the figures, the propeller pump 3 comprises nine guide vanes 18, which are equidistantly distributed along the envelope surface 11 of the pump core 10. However, the propeller pump 3 may comprise another number of guide vanes 18, preferably an uneven number if the propeller 15 comprises an even number of blades 17 in order to avoid resonance when the propeller pump 3 is in operation, and preferably not a multiple of the number of blades 17 of the propeller 15 in order to avoid vibration problems because of resonance. Said at least one guide vane 18 is arc-shaped wherein the suction side (SS) has a convex shape, and the pressure side (PS) has a concave shape, as viewed in the axial direction. That is, the chord of the guide vane is situated on the pressure side (PS) of the same. A tangent to the trailing edge 20 of the guide vane 18 extends preferably in the axial direction. In the embodiment shown, all guide vanes 18 are uniform and the leading edges 19 of all guide vanes 18 are arranged in one and the same transverse geometrical plane. In an alternative embodiment (not shown), the propeller pump 3 may comprise different types of guide vanes that are arranged alternately as viewed in the direction of rotation, which sets of guide vanes may have differently strong arc-shape/radius of curvature and/or be arranged at mutual displacement in the axial direction.

Said at least one guide vane 18 extends between the inner surface 9 of the pump housing 8 and the envelope surface 11 of the pump core 10, and preferably, said at least one guide vane 18 is connected to the envelope surface 11 of the pump core 10, and even more preferably, said at least one guide vane 18 is connected to the inner surface 9 of the pump housing 8. This implies that the pump core 10 does not need other stays or the like to guarantee the position of the same in relation to the pump housing 8. Preferably, all guide vanes 18 are connected to the pump core 10 and the pump housing 8.

Reference is now also made to FIG. 5, which schematically shows a part of a cross-section of a propeller pump 3, wherein the pump housing 8, the envelope surface 11 of the pump core 10, and the leading edges 19 of the guide vanes 18 are seen.

It is central for the present invention that, at the leading edge 19 of said at least one guide vane 18, a connection angle ($\alpha$) between the suction side (SS) of the guide vane 18 and the envelope surface 11 of the pump core 10 is greater than 90°. Preferably, said connection angle is greater than 120°, most preferably around 135°. Note that it is the alternate angle ($\alpha$) that is drawn in FIG. 5. By using a connection angle ($\alpha$) that is greater than 90° between the suction side (SS) of the guide vane 18 and the envelope surface 11 of the pump core 10, at the leading edge 19 of the guide vane 18, a radially inwardly directed pressure gradient is obtained that decreases the boundary layer and that increases the linear momentum in the area between the suction side of the guide vane and the envelope surface of the pump core, thereby the emergence of separation being eliminated in this area.

It is furthermore preferred that, at the leading edge 19 of said at least one guide vane 18, a connection angle ($\beta$) between the suction side (SS) of the guide vane 18 and the inner surface 9 of the pump housing 8 is greater than 90°, preferably said connection angle is greater than 120°. Note that it is the alternate angle ($\beta$) that is drawn in FIG. 5.

It is preferred that the connection angle ($\alpha$) between the suction side (SS) of the guide vane 18 and the envelope surface 11 of the pump core 10 is greater than 90° along the entire axial length of the guide vane 18, preferably said connection angle ($\alpha$) is greater than 120° along the entire axial length of the guide vane 18. By using a connection angle ($\alpha$) that is greater than 90° between the suction side (SS) of the guide vane 18 and the envelope surface 11 of the pump core 10, along the axial length of the entire guide vane 18, an inwardly directed radial pressure gradient is obtained that decreases the boundary layer and increases the linear momentum in the area between the suction side of the guide vane and the envelope surface of the pump core, thereby the emergence of separation being eliminated in this area. In an alternative embodiment, the connection angle ($\alpha$) between the suction side (SS) of the guide vane 18 and the envelope surface 11 of the pump core 10 is greater than 90° along at least ⅔ of the entire axial length of the guide vane 18, preferably greater than 120, as viewed from the leading edge 19 of the guide vane 18.

Figure 6:
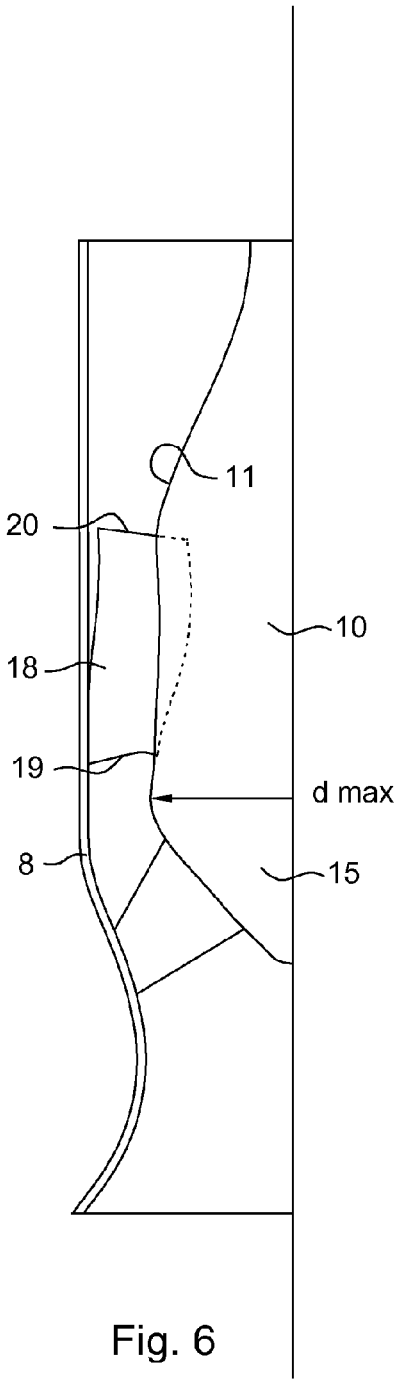
FIG. 6 is an illustration of a cross sectional side view of a propeller pump installation.

Reference is now also made to FIG. 6, which schematically shows a part of a cut-away propeller pump 3.

According to a preferred embodiment, the pump core 10 exhibits, downstream the propeller 15 or in direct connection to the propeller 15, a maximum diameter ($d_{max}$). Furthermore, the leading edge 19 of said at least one guide vane 18 is connected to the envelope surface 11 of the pump core 10 at a point downstream the transverse cross-section where the pump core 10 has maximum diameter ($d_{max}$). This implies that the deflection of the liquid flow in the radial-axial direction essentially occurs between a trailing edge of the blades 17 of the propeller 15 and the leading edge 19 of the guide vane 18, i.e., upstream the deflection in the direction of rotation, which is made by means of the guide vanes 18 or in the so-called guide vane passage that extends from the leading edge 19 of the guide vanes 18 to the trailing edge 20 of the same. The construction of the so-called guide vane passage can be dimensioned/designed without special consideration needing to be given to deflect the liquid flow in the radial-axial direction since this has already been handled upstream the guide vane passage by means of a small radius of curvature of the envelope surface 11 of the pump core 10, as viewed in the axial direction, and thereby the guide vane 18 can be formed with smaller radius of curvature, as viewed in the axial direction, thereby a shorter guide vane passage in the axial direction being obtained. A smaller radius of curvature of the guide vane implies that the axially projected chord of the guide vane becomes shorter. This is due to the fact that the negative pressure gradient created by the radius of curvature of the envelope surface 11 of the pump core 10 does not interact with the negative pressure gradient on the suction side (SS) of the guide vane 18, since the radius of curvature of the envelope surface 11 has entirely or partly leveled out when the liquid reaches said at least one guide vane 18.

The corresponding applies to the construction of the envelope surface 11 of the pump core 10 in the area where the pump core 10 exhibits a maximum diameter ($d_{max}$). That is, the pump core 10 can be dimensioned/designed without special consideration needing to be given as to how the liquid flow/stream is affected by the construction of the guide vane passage, and thereby the envelope surface 11 of the pump core 10 in the area where the pump core 10 exhibits a maximum diameter ($d_{max}$) can be formed with smaller radius of curvature, thereby a propeller pump 3 being obtained having a shorter extension in the axial direction.

According to a preferred embodiment, in the area of the leading edge 19 of said at least one guide vane 18, a cross-sectional area ($A_1$) of said channel 14, which extends from the inlet opening 12 of the pump housing 8 to the outlet opening 13 of the pump housing 8, is smaller than or equal to a cross-sectional area ($A_2$) of said channel 14 in the area of the trailing edge 20 of said at least one guide vane 18. Furthermore, in the area of the trailing edge 20 of said at least one guide vane 18, the cross-sectional area ($A_2$) of said channel 14 is smaller than a factor of 1,2 times the cross-sectional area ($A_1$) of said channel 14 in the area of the leading edge 19 of said at least one guide vane 18. This implies small or no expansion of the channel 14 in the guide vane passage, and thereby said at least one guide vane 18 can be formed with a still smaller radius of curvature, as viewed in the axial direction, i.e., be formed with a shorter axially projected chord.

FEASIBLE MODIFICATIONS OF THE INVENTION

The invention is not limited only to the embodiments described above and shown in the drawings, which primarily have an illustrative and exemplifying purpose. This patent application is intended to cover all adjustments and variants of the preferred embodiments described herein, thus the present invention is defined by the wording of the appended claims and the equipment may be modified in all kinds of ways within the scope of the appended claims.

It shall also be pointed out that all information about/concerning terms such as above, under, upper, lower, etc., shall be interpreted/read having the equipment oriented according to the figures, having the drawings oriented such that the references can be properly read. Thus, such terms only indicates mutual relations in the shown embodiments, which relations may be changed if the inventive equipment is provided with another structure/design.

It shall also be pointed out that even thus it is not explicitly stated that features from a specific embodiment may be combined with features from another embodiment, the combination shall be considered obvious, if the combination is possible.

The invention claimed is:

1. A propeller pump for pumping liquid, comprising:

an axially extending tubular pump housing having an inner surface, an axially extending pump core having an envelope surface, at least one axial portion of the pump core enclosed in said pump housing, and the pump core comprising a propeller having a hub and at least one blade, at least one guide vane having an upstream located leading edge and a downstream located trailing edge, the at least one guide vane in a circumferential direction having a pressure side and a suction side, said at least one guide vane extending between the inner surface of the pump housing and the envelope surface of the pump core, a connection angle between the suction side of the guide vane and the envelope surface of the pump core greater than 90 degrees at the leading edge of said at least one guide vane, and a maximum diameter (dmax) of the pump core located downstream of the propeller, the leading edge of said at least one guide vane connected to the envelope surface of the pump core at a location downstream of the maximum diameter (dmax) of the pump core.

2. The propeller pump according to claim 1, wherein the connection angle between the suction side of the guide vane and the envelope surface of the pump core is larger than 120 degrees at the leading edge of the guide vane.

3. The propeller pump according to claim 1, wherein the connection angle between the suction side of the guide vane and the envelope surface of the pump core; is larger than 90 degrees along an entire axial length of the guide vane.

4. The propeller pump according to claim 3, wherein the connection angle between the suction side of the guide vane and the envelope surface of the pump core, is larger than 120 degrees along the entire axial length of the guide vane.

5. The propeller pump according to claim 1, wherein the propeller pump comprises an axially extending channel extending from an inlet opening of the pump housing to an outlet opening of the pump housing, which channel in a radial direction is delimited by the inner surface of the pump housing and the envelope surface of the pump core, respectively, said channel having a cross sectional area adjacent the leading edge of said at least one guide vane less than or equal to a cross sectional area of said channel adjacent the trailing edge of said at least one guide vane, and the cross sectional area of said channel adjacent the trailing edge of said at least one guide vane is less than a factor of 1.2 times the cross sectional area of said channel adjacent the leading edge of said at least one guide vane.

6. The propeller pump according to claim 1, wherein the pump core and the pump housing are concentrically arranged.

7. The propeller pump according to claim 1, wherein the propeller comprises five blades, and the propeller pump comprises nine guide vanes.

* * * * *